US011602827B1

(12) United States Patent
Weaver

(10) Patent No.: US 11,602,827 B1
(45) Date of Patent: Mar. 14, 2023

(54) PIVOTING AND EXTENDING INTERCHANGEABLE HAND TOOL DEVICE

(71) Applicant: Nathaniel Weaver, Irvine, CA (US)

(72) Inventor: Nathaniel Weaver, Irvine, CA (US)

( * ) Notice: Subject to any disclaimer, the term of this patent is extended or adjusted under 35 U.S.C. 154(b) by 0 days.

(21) Appl. No.: 17/849,553

(22) Filed: Jun. 24, 2022

(51) Int. Cl.

| | |
|---|---|
| ***B25B 23/00*** | (2006.01) |
| ***B25G 1/00*** | (2006.01) |
| ***B25G 1/04*** | (2006.01) |
| ***B25B 13/48*** | (2006.01) |

(52) U.S. Cl.
CPC ..... *B25B 23/0028* (2013.01); *B25G 1/005* (2013.01); *B25G 1/043* (2013.01); *B25B 13/481* (2013.01)

(58) Field of Classification Search
CPC ... B25B 23/0028; B25B 13/481; B25G 1/005; B25G 1/043
See application file for complete search history.

(56) References Cited

U.S. PATENT DOCUMENTS 2,819,637 A * 1/1958 St Pierre ..... B25B 13/481 81/98
4,542,667 A * 9/1985 Jang ..... B25G 1/005 81/177.4
5,957,011 A * 9/1999 Thompson ..... B25B 13/48 81/461
7,497,149 B2 * 3/2009 Lin ..... B25B 13/461 81/62
9,232,854 B2 * 1/2016 Ladva ..... A46B 15/0081
2016/0107296 A1 * 4/2016 Marcelle ..... B25B 23/0007 81/98

* cited by examiner

*Primary Examiner* — Hadi Shakeri

(74) *Attorney, Agent, or Firm* — Pharar Patents & Intellectual Property; Andrew A. Pharar

(57) ABSTRACT

The pivoting and extending interchangeable hand tool device disclosed herein may comprise a tool head and a torque arm that pivot relative to one another, a secondary torque arm for extending length and increasing appliable torque, and a "T"-handle for additional support. The pivoting and extending interchangeable hand tool device may further comprise a plurality of tool heads that may be interchanged within the secondary torque arm, and may be provided commercially in a multiple-tool set. The device is designed to overcome the shortcomings in the prior art, which specifically include the ability to work in tight spaces while reducing the loss of torque when pivoting a torque arm, the loss of strength inherent in an extendable torque arm, and the bulkiness of a "T"-handle.

1 Claim, 13 Drawing Sheets

PIVOTING AND EXTENDING INTERCHANGEABLE HAND TOOL DEVICE

TECHNICAL FIELD OF THE INVENTION

The present invention relates in general to hand tools, and, more specifically, to a pivoting and extending interchangeable hand tool device.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

A hand tool is a device held in the hand that can be used to manipulate, measure, cut, or apply torque to an object using manual power. Such tools have been in use since the dawn of man, and the variations of hand tools is now very broad though specifically excludes those devices powered by a motor. Categories of hand tools include wrenches, pliers, cutters, files, striking tools, hammered tools, screwdrivers, vises, clamps, snips, hacksaws, drills, and knives.

The need for such an extensive list of categories is caused by the ubiquitous need for hand tools, the design of which can be adjusted and modified to suit any appropriate task. There are, for example, hand tools meant for work specifically on an automobile, which may include ratchets and sockets, body panel separators, compression testers, and other specialized tools. Hand tools used specifically in the medical industry, by contrast, may include scalpels, forceps, otoscopes, and hemostats, among a long list of other devices.

Another designed use of hand tools, which may be known as "plumber's tools" or "plumbing tools", includes those tools that are intended for use on various pipes, fittings, and fixtures related to plumbing. This category of hand tools includes pipe wrenches, pipe cutters, strap wrenches, basin wrenches, and a number of other related tools.

The nature of plumbing work, though, is that the area in which work is performed is often very small or very tight, and this nature necessarily inhibits the possible designs that a specialized tool can take on. By way of example, working on pipes under a sink requires a user to, usually, work upside down in a dark, damp, and small area. The length of a torque arm is necessarily limited due to the availability of space, but the wrench must still be able to apply sufficient torque to create or break a watertight seal.

One solution known in the art for working in a tight area is to add a pivoting tool head to the torque arm, which allows the arm to be angled relative to the tool head itself into a space where it may be torqued. The problem with such a solution, though, is that the angling of the torque arm necessarily reduces its effective length relative to the tool head and, thus, reduces the amount of torque that can be applied by the user.

Another solution known in the art for working in a tight area is to implement a telescoping or extending torque arm, which allows the arm to be lengthened or shortened relative to the tool head itself. This solution, also, creates the issue of increasing or decreasing the amount of torque a user can apply, since torque is greater when applied further away from the tool head. Moreover, this solution also creates the problem of providing a potentially weaker torque arm as it may tend to be both circular in cross-section and hollow to allow for telescoping.

A third solution known in the art for working in a tight space is to implement a "T"-handle that may be attached to a tool head or a torque arm. A "T"-handle may be, generally, a shorter pair of arms extending perpendicularly from the primary torque arm that may allow a user to offset some of the torque loss caused by pivoting the torque arm relative to the tool head. A "T"-handle may also act as a guard or a retainer, allowing the user to better hold onto a hand tool, or may be used to apply torque to the tool head perpendicularly to the primary torque arm.

There is no known solution that combines all of these elements into a single, advantageous device.

Thus, there is a need in the art for a pivoting and extending interchangeable hand tool device that may comprise a tool head and a torque arm that pivot relative to one another, a secondary torque arm for extending length and increasing appliable torque, and a "T"-handle for additional support. The pivoting and extending interchangeable hand tool device may further comprise a plurality of tool heads that may be interchanged within the secondary torque arm, and may be provided commercially in a multiple-tool set. The device is designed to overcome the shortcomings in the prior art, which specifically include the ability to work in tight spaces while reducing the loss of torque when pivoting a torque arm, the loss of strength inherent in an extendable torque arm, and the bulkiness of a "T"-handle. It is to these ends that the present invention has been developed.

BRIEF SUMMARY OF THE INVENTION

To minimize the limitations in the prior art, and to minimize other limitations that will be apparent upon reading and understanding the present specification, the present invention describes a pivoting and extending interchangeable hand tool device.

It is an objective of the present invention to provide a pivoting and extending interchangeable hand tool device that may comprise a hand tool.

It is another objective of the present invention to provide a pivoting and extending interchangeable hand tool device that may comprise a tool head.

It is another objective of the present invention to provide a pivoting and extending interchangeable hand tool device that may comprise a torque arm.

It is another objective of the present invention to provide a pivoting and extending interchangeable hand tool device that may comprise a pivot.

It is another objective of the present invention to provide a pivoting and extending interchangeable hand tool device that may comprise a length lock.

It is another objective of the present invention to provide a pivoting and extending interchangeable hand tool device that may comprise a support arm.

It is another objective of the present invention to provide a pivoting and extending interchangeable hand tool device that may comprise an extension body.

It is another objective of the present invention to provide a pivoting and extending interchangeable hand tool device that may comprise a tool receiver.

It is another objective of the present invention to provide a pivoting and extending interchangeable hand tool device that may comprise a plurality of length selectors.

It is another objective of the present invention to provide a pivoting and extending interchangeable hand tool device that may comprise a plurality of T-arms.

It is another objective of the present invention to provide a pivoting and extending interchangeable hand tool device that may comprise a rectangular cross-section.

It is another objective of the present invention to provide a pivoting and extending interchangeable hand tool device that may comprise a square cross-section.

It is another objective of the present invention to provide a pivoting and extending interchangeable hand tool device that may comprise a resilient material of construction.

It is another objective of the present invention to provide a pivoting and extending interchangeable hand tool device that may comprise a water-proof material of construction.

It is another objective of the present invention to provide a pivoting and extending interchangeable hand tool device that may comprise a reusable material of construction.

It is another objective of the present invention to provide a pivoting and extending interchangeable hand tool device that may comprise an antioxidizing layer.

It is another objective of the present invention to provide a pivoting and extending interchangeable hand tool device that may comprise an antioxidizing material of construction.

It is another objective of the present invention to provide a pivoting and extending interchangeable hand tool device that may comprise an antimicrobial layer.

It is another objective of the present invention to provide a pivoting and extending interchangeable hand tool device that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, or in reference to human anatomy in accordance with the present disclosure. Unless specifically set forth herein, the terms "a," "an," and "the" are not limited to one element, but instead should be read as meaning "at least one." The terminology includes the words noted above, derivatives thereof, and words of similar import.

The pivoting and extending interchangeable hand tool device disclosed herein may comprise a tool head and a torque arm that pivot relative to one another, a secondary torque arm for extending length and increasing appliable torque, and a "T"-handle for additional support. The pivoting and extending interchangeable hand tool device may further comprise a plurality of tool heads that may be interchanged within the secondary torque arm, and may be provided commercially in a multiple-tool set. The device is designed to overcome the shortcomings in the prior art, which specifically include the ability to work in tight spaces while reducing the loss of torque when pivoting a torque arm, the loss of strength inherent in an extendable torque arm, and the bulkiness of a "T"-handle.

Figure 1:
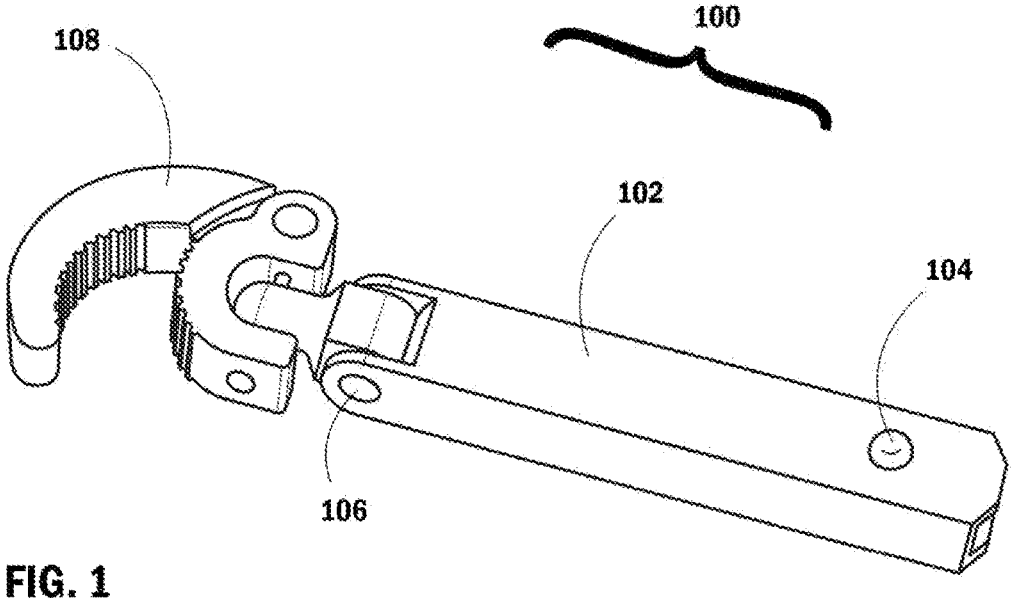
FIG. 1 is an isometric perspective view of a first embodiment of a hand tool of a pivoting and extending interchangeable hand tool device, as contemplated by the present disclosure.
Figure 2:
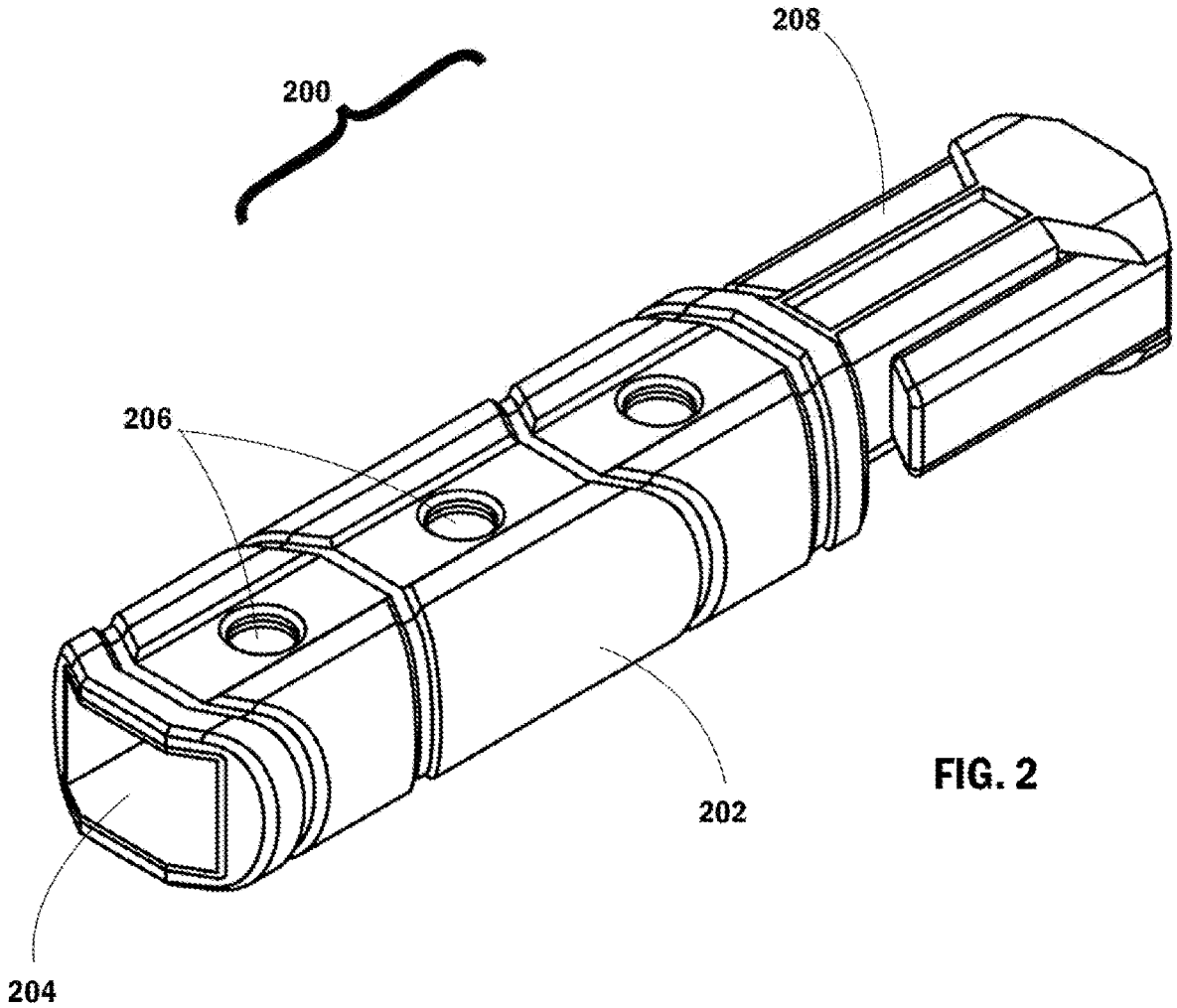
FIG. 2 is an isometric perspective view of a support arm of a pivoting and extending interchangeable hand tool device, as contemplated by the present disclosure.
Figure 3:
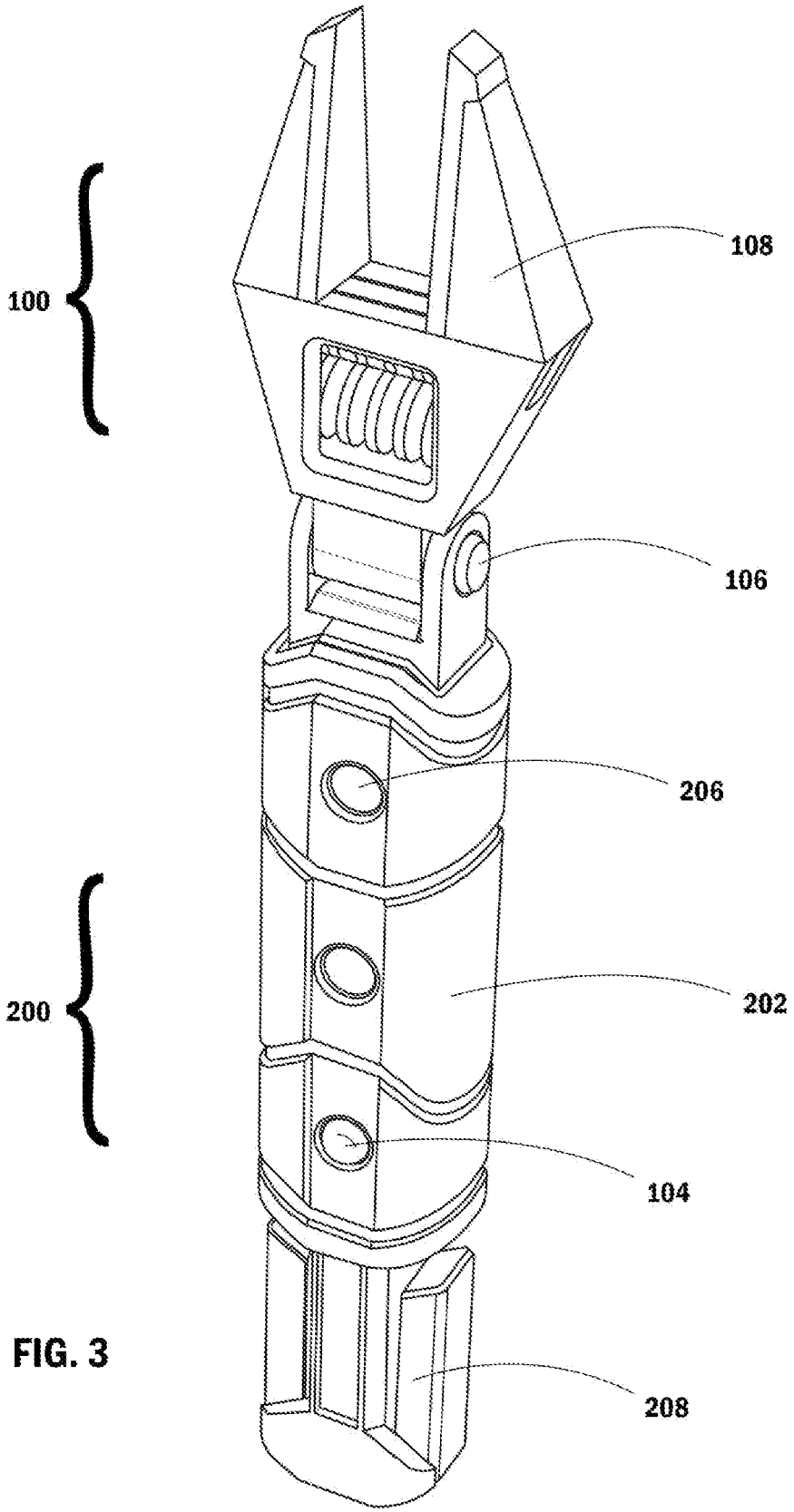
FIG. 3 is an overall view of a pivoting and extending interchangeable hand tool device, as contemplated by the present disclosure.
Figure 4:
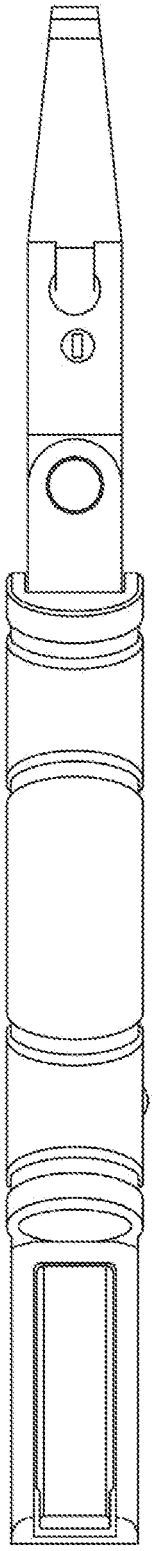
FIG. 4 is a left side view of a pivoting and extending interchangeable hand tool device, as contemplated by the present disclosure.
Figure 5:
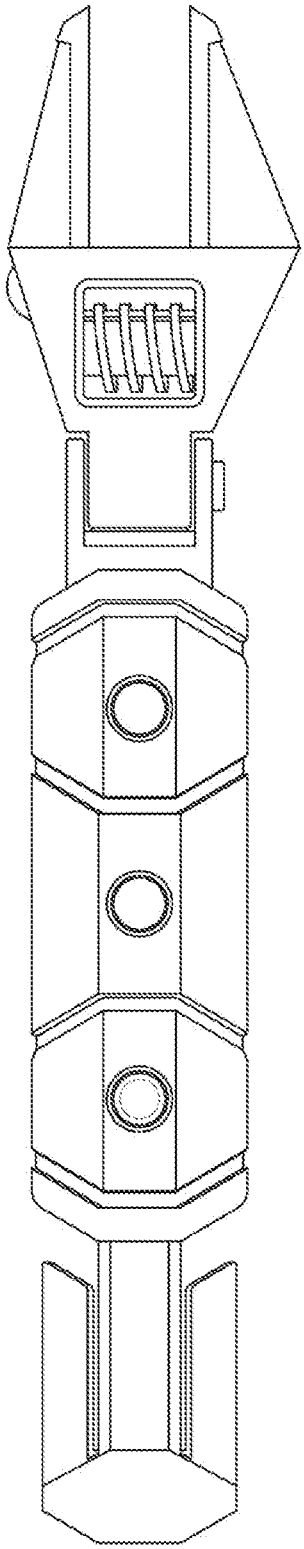
FIG. 5 is a front view of a pivoting and extending interchangeable hand tool device, as contemplated by the present disclosure.
Figure 6:
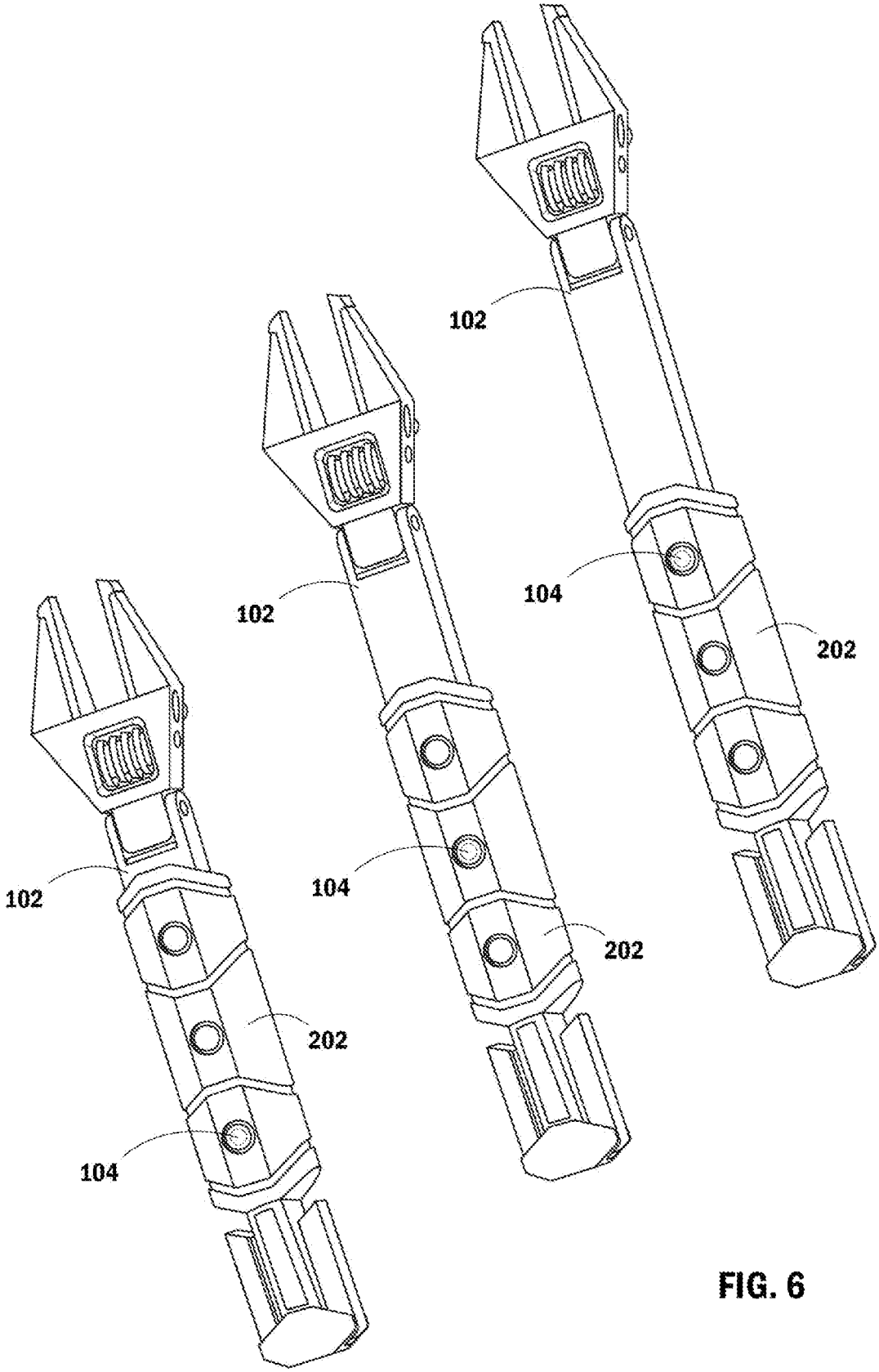
FIG. 6 is an overall view of a length extending mechanism of a pivoting and extending interchangeable hand tool device, as contemplated by the present disclosure.
Figure 7:
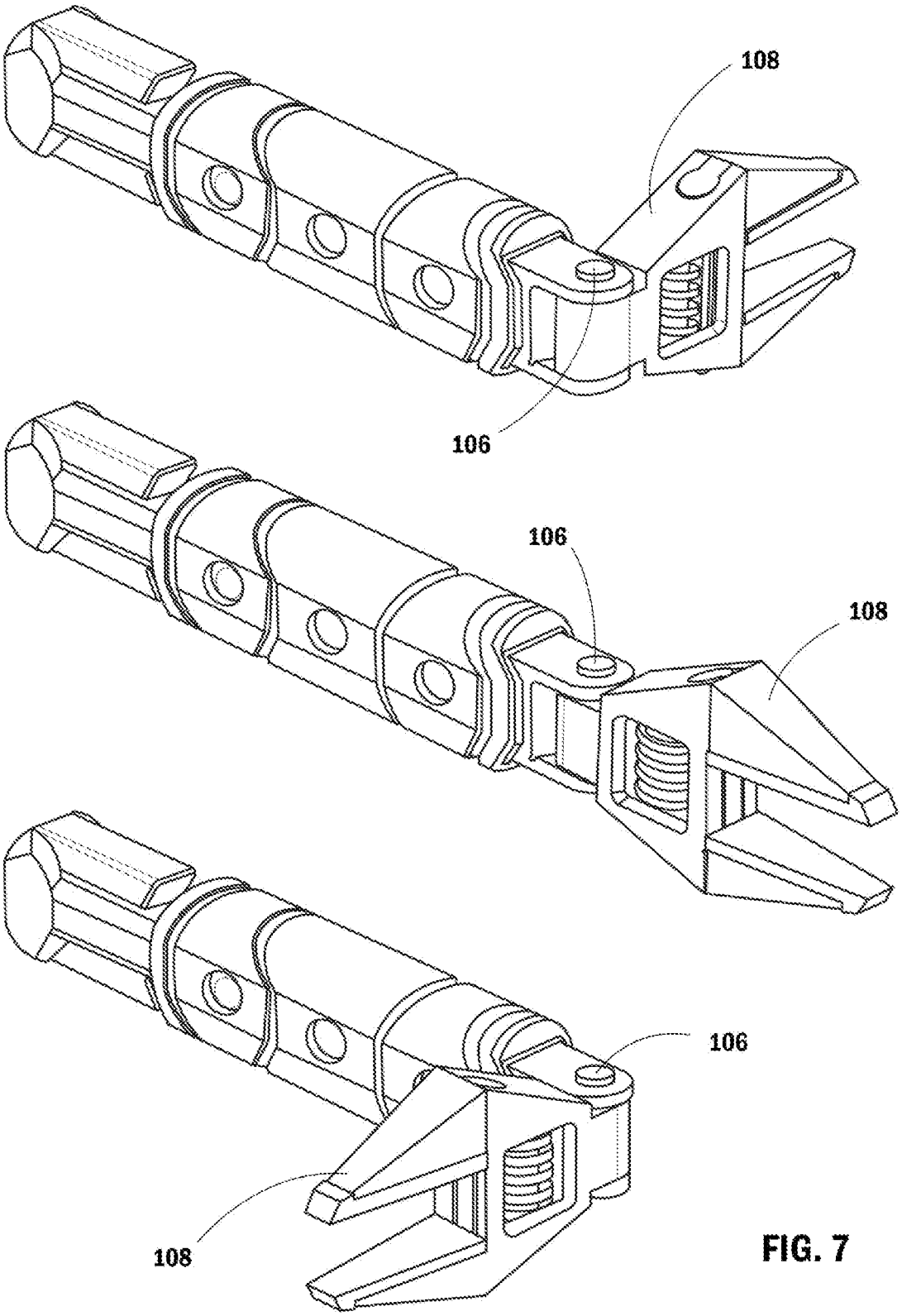
FIG. 7 is an overall view of a tool head pivoting mechanism of a pivoting and extending interchangeable hand tool device, as contemplated by the present disclosure.
Figure 8:
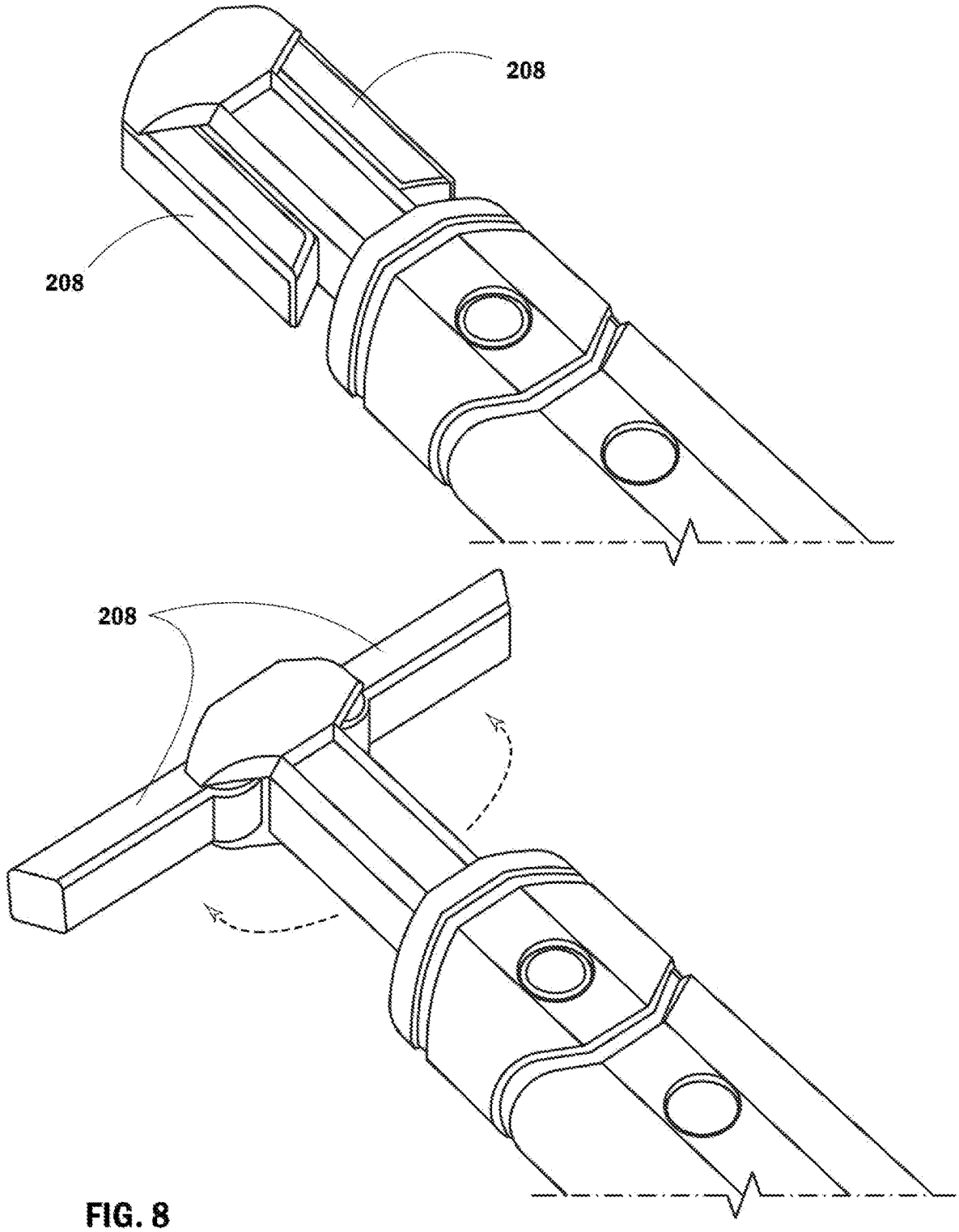
FIG. 8 is an overall view of a T-arm mechanism of a pivoting and extending interchangeable hand tool device, as contemplated by the present disclosure.
Figure 9:
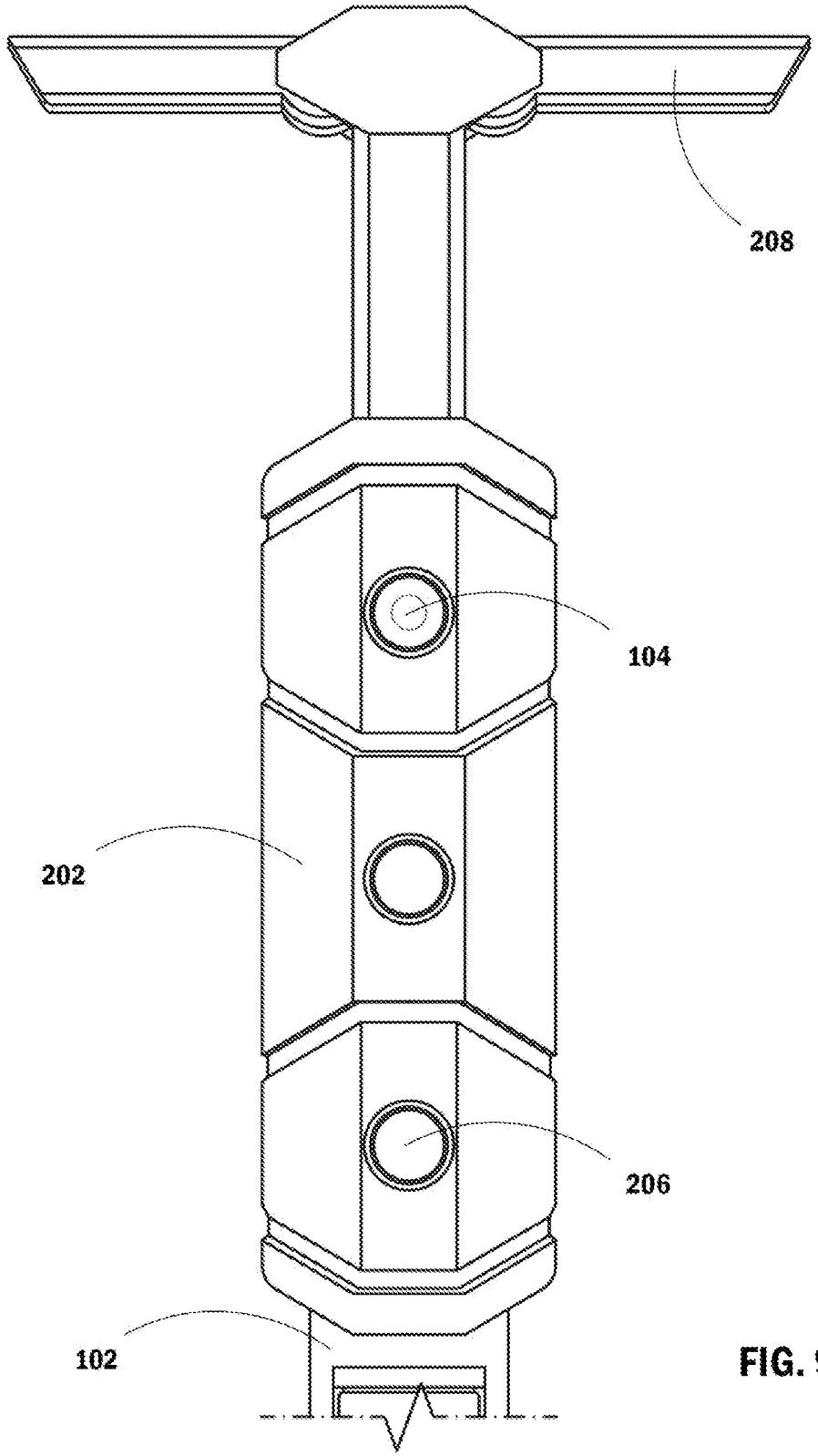
FIG. 9 is a front view of a support arm of a pivoting and extending interchangeable hand tool device with T-arms extended, as contemplated by the present disclosure.
Figure 10:
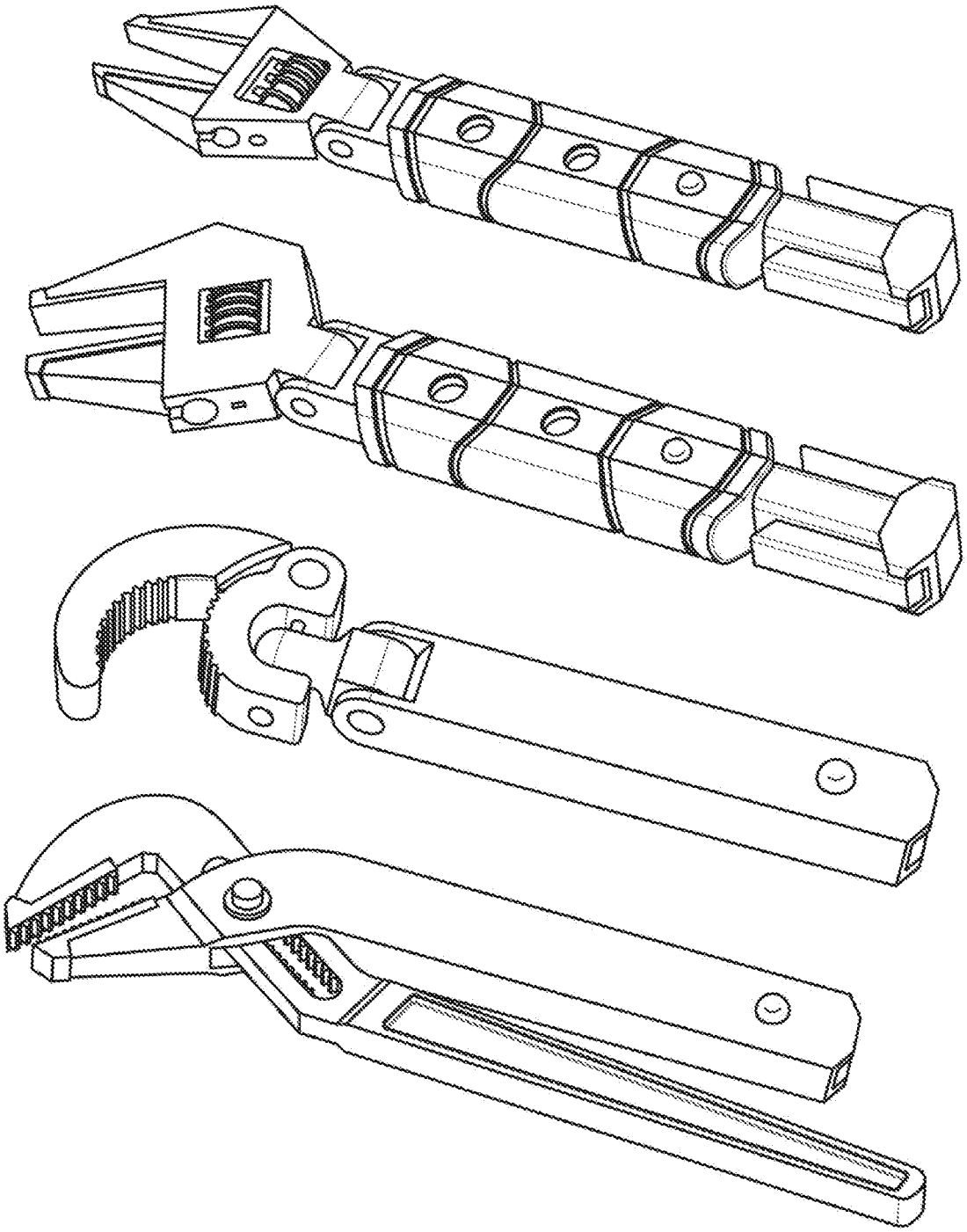
FIG. 10 is an overall view of a plurality of interchangeable hand tools of a pivoting and extending interchangeable hand tool device, as contemplated by the present disclosure.
Figure 11:
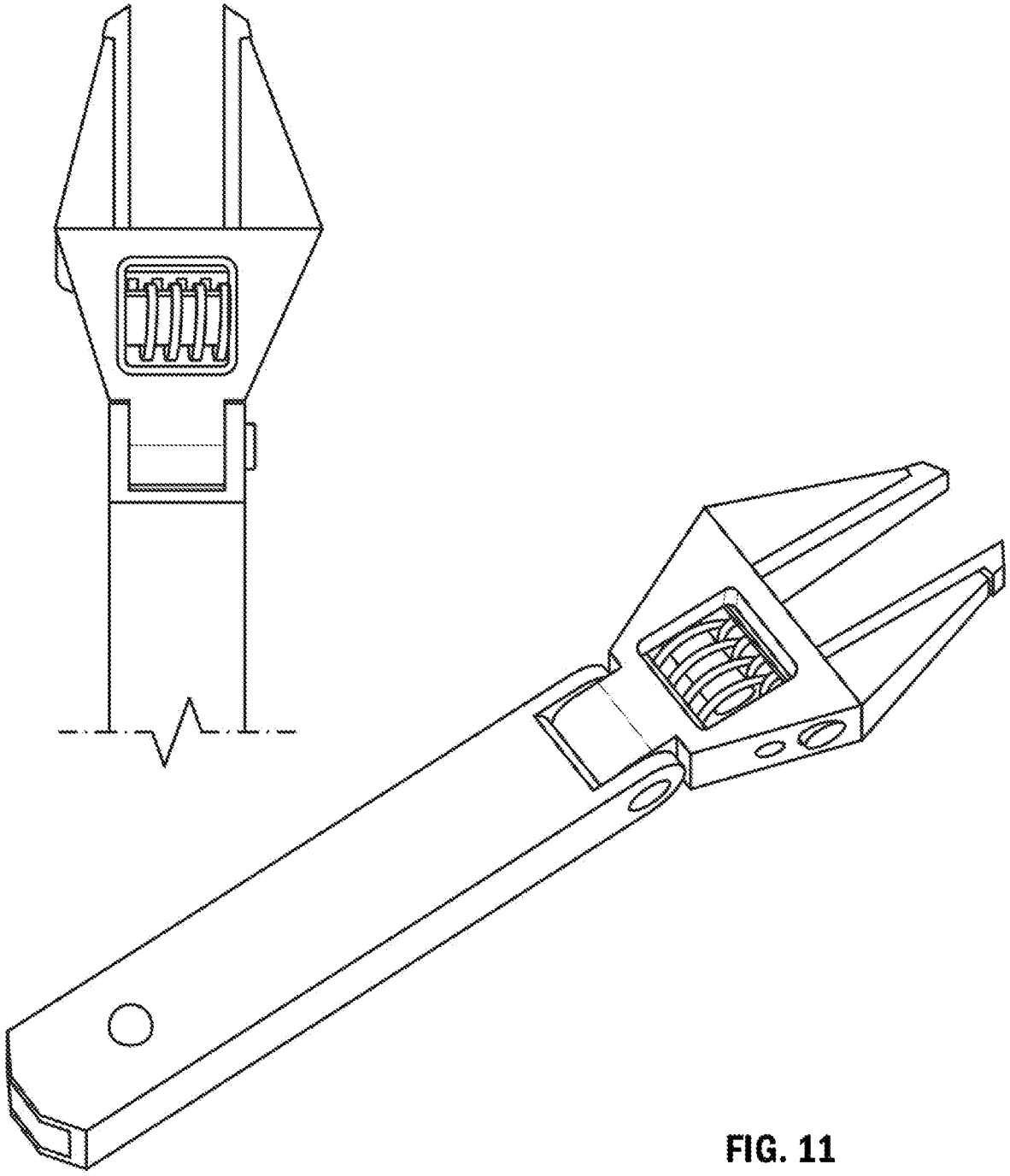
FIG. 11 is an overall view of a first embodiment of a hand tool of a pivoting and extending interchangeable hand tool device, as contemplated by the present disclosure.
Figure 12:
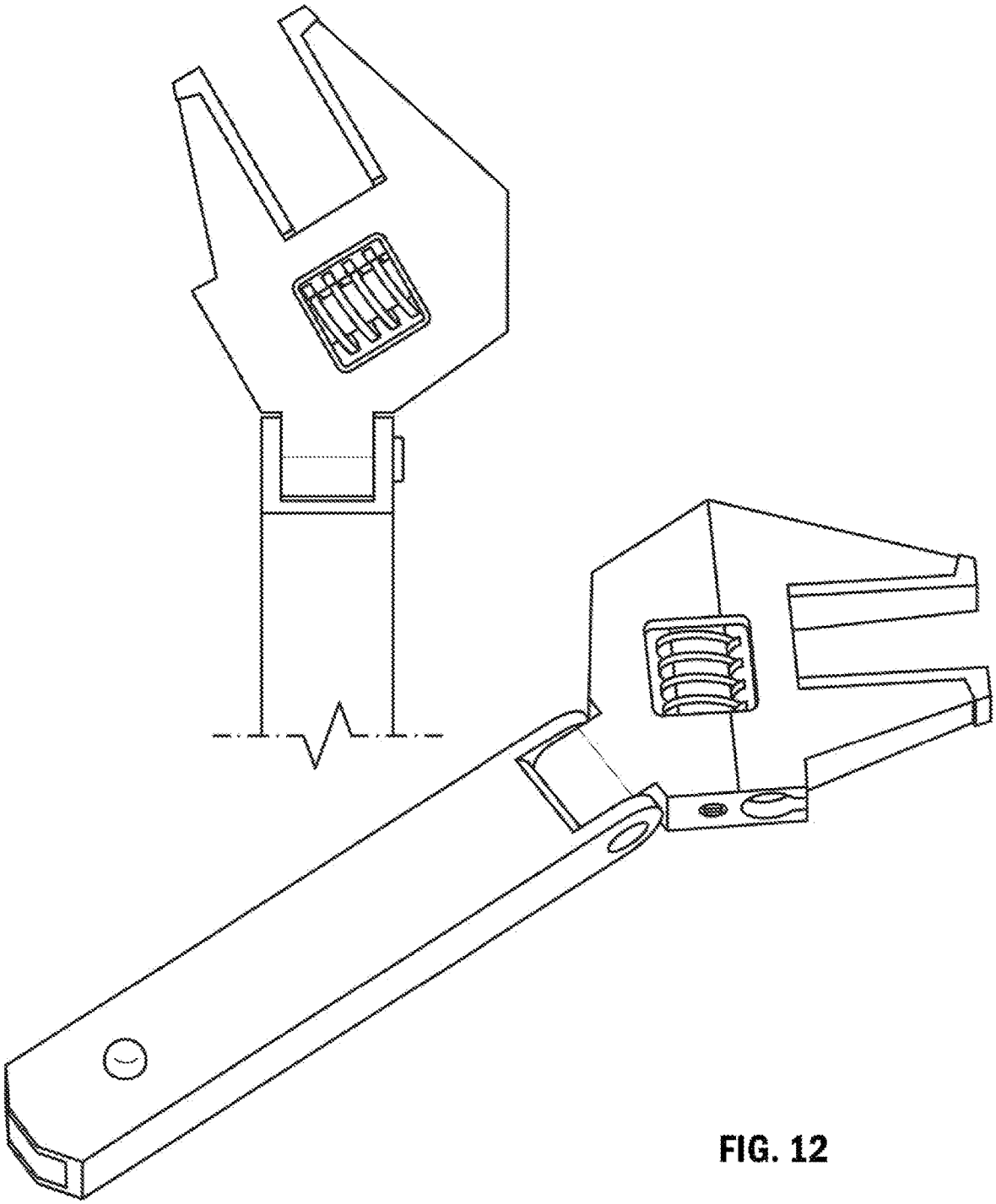
FIG. 12 is an overall view of a second embodiment of a hand tool of a pivoting and extending interchangeable hand tool device, as contemplated by the present disclosure.
Figure 13:
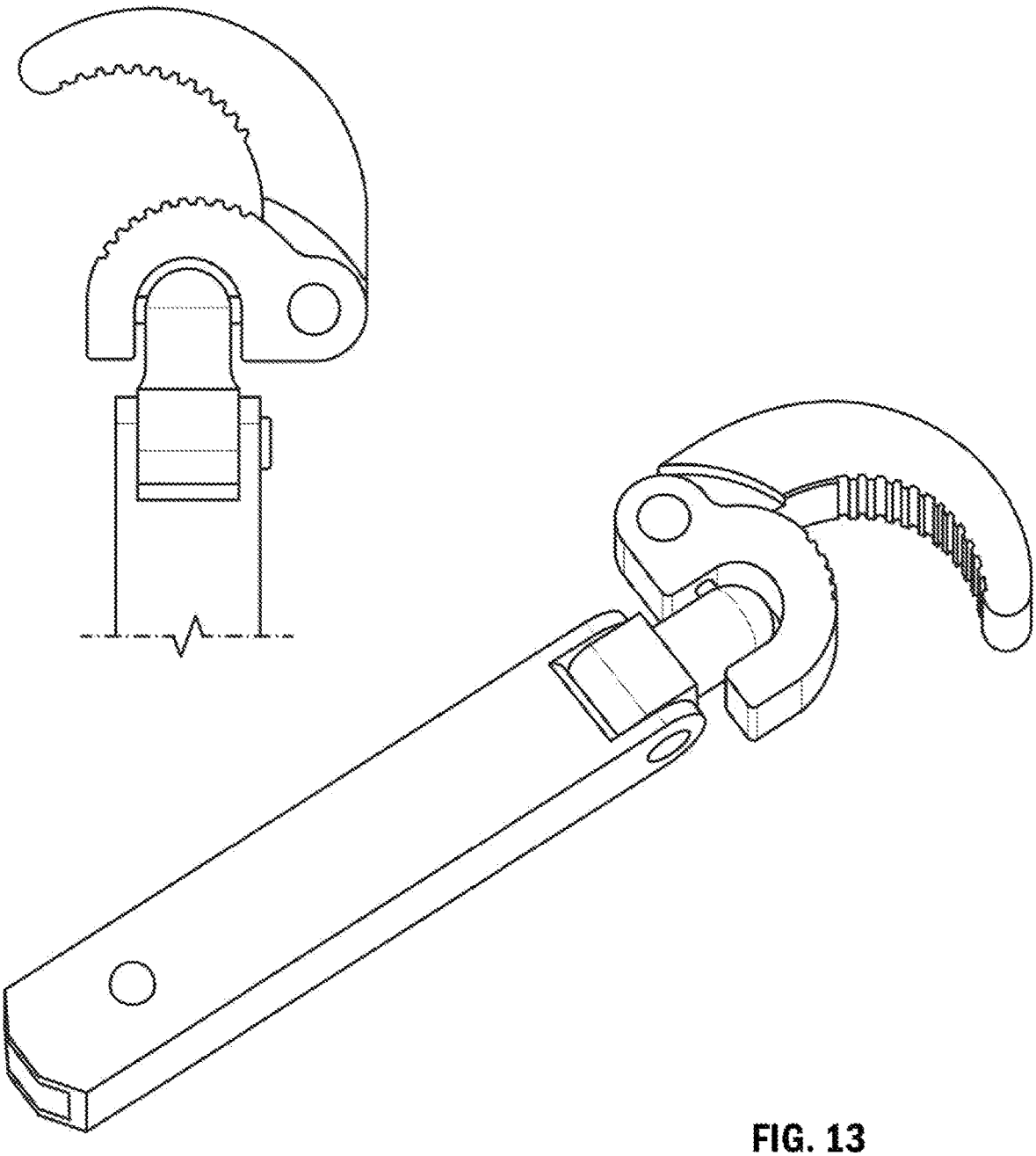
FIG. 13 is an overall view of a third embodiment of a hand tool of a pivoting and extending interchangeable hand tool device, as contemplated by the present disclosure.
Figure 14:
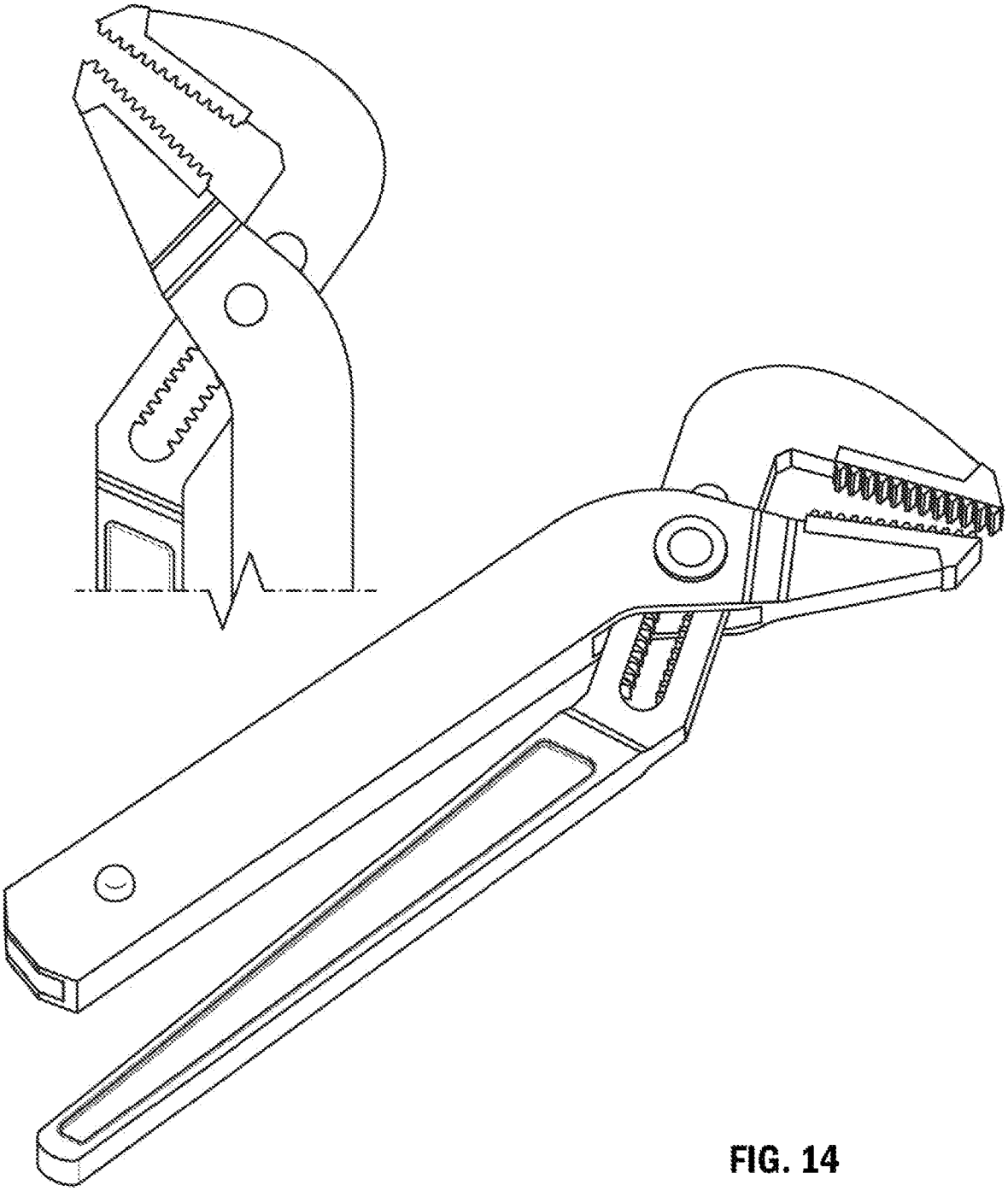
FIG. 14 is an overall view of a fourth embodiment of a hand tool of a pivoting and extending interchangeable hand tool device, as contemplated by the present disclosure.
Figure 15:
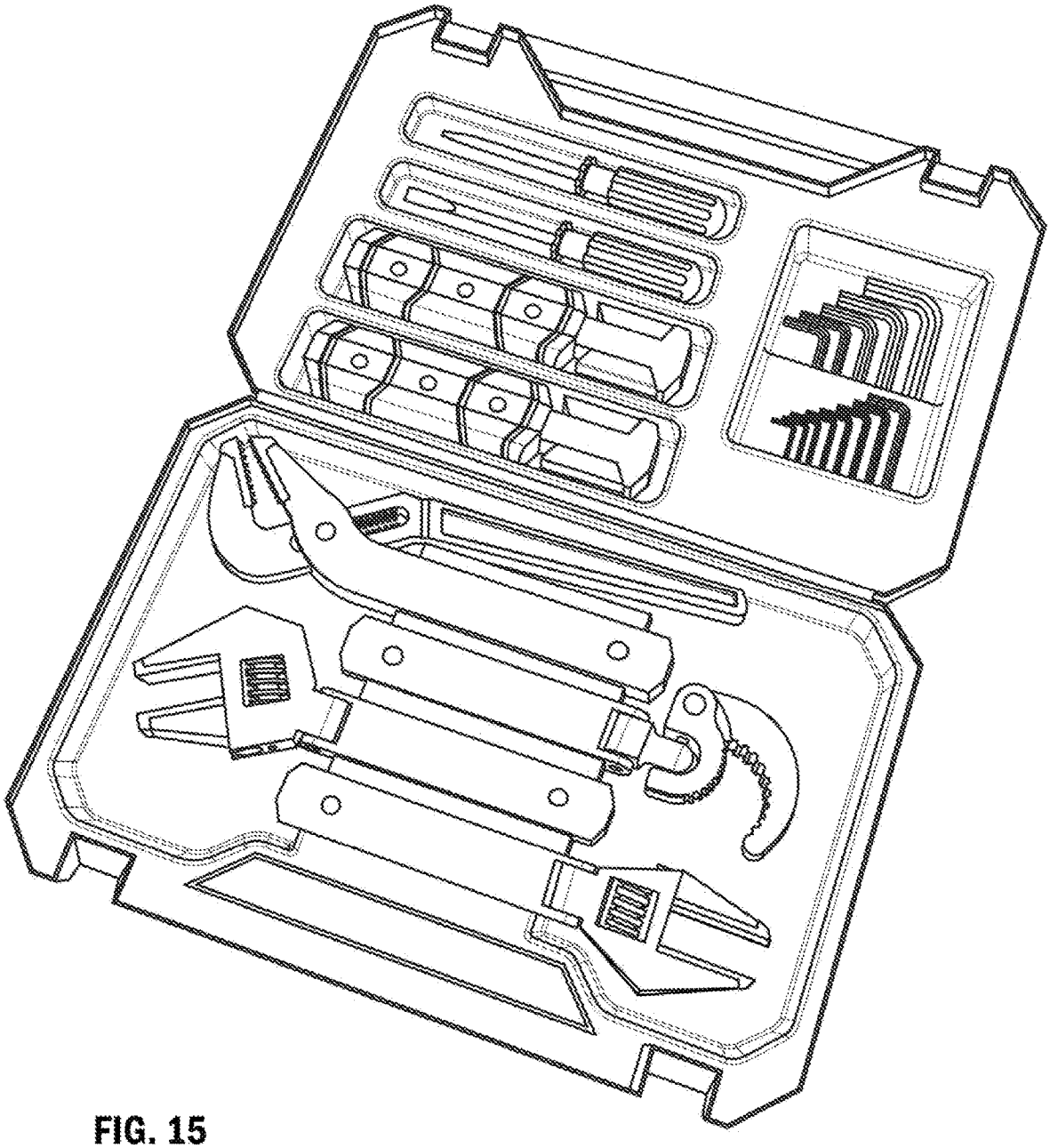
FIG. 15 is an overall view of a plurality of hand tools and a plurality of support arms of a pivoting and extending interchangeable hand tool device, as contemplated by the present disclosure.

The illustrations of FIGS. 1-15 illustrate a pivoting and extending interchangeable hand tool device, as contemplated by the present disclosure. The pivoting and extending interchangeable hand tool device may comprise, generally, a hand tool 100 and a support arm 200.

The hand tool 100 may comprise any appropriate hand tool such as, for example, a basin wrench, an adjustable wrench, a needle nose plier, a channel lock plier, or any other hand tool. As contemplated by the present disclosure the hand tool 100 further comprises a torque arm 102 having a proximal end and a distal end. The torque arm 102 may comprise any appropriate arm having any appropriate cross-section, such as a circular, square, or triangular cross-section, though it is preferred in the present disclosure for the torque arm 102 to comprise a rectangular cross-section to provide the device with maximum torsion resistance. The torque arm 102 may be hollow or solid, as desired for a particular embodiment.

The proximal end of the torque arm 102 may further comprise a length lock 104, which may comprise any appropriate locking mechanism such as, for example, a spring-loaded button, a channel into which a locking pin may be inserted, a spring-loaded ball bearing, or any other locking mechanism. In one embodiment the length lock 104 may comprise a button embedded within and protruding outwards from a proximal end of the torque arm 102 and reversibly pressed against the torque arm 102 by an appropriate force, such as a spring pressing against the length lock 104. The length lock 104 may be pressed into the torque arm 102 by a user of the device, and may return to its original position when such pressing force is removed.

The distal end of the torque arm 102 may further comprise a pivot mechanism 106, which may comprise any appropriate pivoting mechanism such as, for example, an axle that allows for relative rotation of two components around an arc of movement. In one embodiment the pivot mechanism 106 may comprise a tubular axle, the ends of which may be inserted into circular openings located at a distal end of the torque arm 102, and the body of which may be attached to a tool head 108. By such a design the tool head 108 may be allowed to pivot through an arc of motion relative to the torque arm 102. The pivot mechanism 106 may further comprise a locking component that allows the tool head 108 to be positioned at and held in pre-determined angles relative to the torque arm 102. The locking component may comprise any appropriate locking component such as, for example, a spring-loaded ball bearing paired with a plurality of divots, a channel into which a locking pin may be inserted, or any other locking mechanism.

The tool head 108 may comprise any appropriate tool head such as, for example, a pipe wrench, a pipe cutter, an adjustable wrench, a locking plier, a channel lock plier, or any other appropriate tool head. As contemplated by the present disclosure, in an embodiment wherein the tool head 108 comprises two arms that are articulated relative to one another, such as a plier, the torque arm 102 may comprise either only one arm or both arms of the device.

The support arm 200 may comprise a handle or extension arm that may be reversibly attached to the hand tool 100. As contemplated by the present disclosure the support arm 200 further comprises an extension body 202 having a proximal end and a distal end. The extension body 202 may further comprise an outer wrapping and a hollow central cavity. The outer wrapping of the extension body 202 may be any shape appropriate for providing a comfortable handle for use by a user. The hollow central cavity of the extension body 202 may comprise a cavity having any appropriate cross-section, such as a circular, square, or triangular cross-section matching the cross-section of the torque arm 102, though it is preferred in the present disclosure for the hollow central cavity of the extension body 202 to comprise a rectangular cross-section to provide the device with maximum torsion resistance.

The extension body 202 may further comprise a tool receiver 204, which may comprise an opening in the distal end of the extension body 202 leading into the hollow central cavity. The opening of the tool receiver 204 may be appropriately sized to snugly receive the body of the torque arm 102 therein, so that the torque arm 102 may be reversibly inserted into the hollow central cavity of the extension body 202.

The extension body 202 may further comprise a plurality of length selectors 206 along its length, which may comprise any length selectors complementary to the length lock 104 of the hand tool 100. By way of example, in an embodiment wherein the length lock 104 comprises a spring-loaded button or a channel the plurality of length selectors 206 may comprise openings in the extension body 202 into which the button may project or a pin may be inserted. In an embodiment wherein the length lock 104 comprises a spring-loaded ball bearing the plurality of length selectors 206 may comprise a plurality of divots allowing the ball bearing to lock into place.

The proximal end of the extension body 202 may further comprise a plurality of T-arms 208, which may be any arms that are attached to the proximal end of the extension body 202 such that they can articulate outwards relative to the extension body 202. The plurality of T-arms 208 may be attached to the extension body 202 by an articulating mechanism that allows the plurality of T-arms 208 to be positioned at and held in pre-determined angles relative to the extension body 202. The articulating mechanism may comprise any appropriate locking component such as, for example, a spring-loaded ball bearing paired with a plurality of divots, a channel into which a locking pin may be inserted, or any other locking mechanism.

As contemplated by the present disclosure the mechanism of attachment between the various components discussed herein may be by any appropriate physical means such as, for example, welding, soldering, binding, bolting, screwing, inserting, gluing, melting, adhering, or being formed from a single block of material.

To begin using the pivoting and extending interchangeable hand tool device a user may first select a hand tool 100 from a plurality of hand tools and may compress or otherwise disengage the length lock 104 of the hand tool 100. The user may then advance the proximal end of the torque arm 102 through the tool receiver 204 and into the hollow central cavity of the extension body 202 of the support arm 200. The user may select a desired length adjustment by placing the length lock 104 proximate to a selected one of the plurality of length selectors 206 and may then reengage the length lock 104 of the hand tool 100. By this mechanism the user has selected and set a desired overall length for the device. The user may again disengage the length lock 104 to remove the hand tool 100 from the support arm 200.

To continue using the using the pivoting and extending interchangeable hand tool device a user may compress or otherwise disengage a locking mechanism of the pivot mechanism 106 of the torque arm 102, if equipped. The user may then pivot the tool head 108 relative to the torque arm 102 to a desired angle. The user may then reengage the locking mechanism of the pivot mechanism 106, if equipped, and use the device. The user may again disengage the locking mechanism of the pivot mechanism 106 to change the angle of the tool head 108 relative to the torque arm 102. In one embodiment of the device the pivot mechanism 106 may comprise a plurality of stops approximately fifteen (15) degrees offset from one another.

To continue using the using the pivoting and extending interchangeable hand tool device a user may pull or otherwise disengage a locking mechanism of the plurality of T-arms 208, if equipped. The user may then articulate the plurality of T-arms 208 relative to the extension body 202 until they are at a desired angle. The user may then reengage the locking mechanism of the plurality of T-arms 208, if equipped, and use the device. The user may again disengage the locking mechanism of the plurality of T-arms 208 to change the angle of the plurality of T-arms 208 relative to the extension body 202. In one embodiment of the device the plurality of T-arms 208 may comprise a plurality of stops approximately thirty (30) degrees offset from one another.

The pivoting and extending interchangeable hand tool device may be substantially constructed of any suitable material or combination of materials, but typically is constructed of a resilient material or combination of materials such that the device is easily manufactured, resistant to damage, and reusable. As an example, and without limiting the scope of the present invention, various exemplary embodiments of the pivoting and extending interchangeable hand tool device may be substantially constructed of one or more materials of steel, stainless steel, iron, aluminum, brass, fiberglass, carbon fiber, plastic, acrylic, polycarbonate, or combinations thereof. In some embodiments the various components of the device may be coated, lined, or otherwise insulated to prevent contamination of the device.

In one embodiment the pivoting and extending interchangeable hand tool device may comprise a resilient material of construction that either comprises a material having antioxidizing properties or comprises a layering of antioxidizing material or coating to prevent oxidation damage to the device and its components. In one embodiment the pivoting and extending interchangeable hand tool device may comprise a resilient material of construction that either comprises a material having antimicrobial properties or comprises a layering of antimicrobial material or coating to prevent contamination of the device and its components. Copper and its alloys, in particular, have exceptional desirable effects. Silver also has these effects, and is less toxic to users than copper.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A pivoting and extending interchangeable multi-tool set, comprising:

a plurality of hand tools; and a plurality of support arms;

wherein each of said plurality of hand tools further comprise a torque arm, a length lock, a pivot mechanism, and a tool head;

wherein each of said plurality of support arms further comprises an extension body, a tool receiver, a plurality of length selectors, and a plurality of T-arm halves;

wherein said torque arm further comprises a proximal end and a distal end;

wherein said extension body further comprises a proximal end, a distal end, and a hollow central cavity;

wherein said length lock is attached to said torque arm;

wherein said pivot mechanism is attached to said distal end of said torque arm;

wherein said tool head is attached to said pivot mechanism;

wherein said tool receiver comprises an opening in said distal end of said extension body leading into said hollow central cavity of said central body;

wherein said plurality of length selectors are attached to said extension body;

wherein said plurality of T-arm halves are attached to said distal end of said extension body;

wherein said torque arm is reversibly inserted into said extension body;

wherein said pivot mechanism further comprises a locking-component that allows said tool head to be positioned at and held in pre-determined angles relative to said torque arm, wherein said length lock comprises a spring-loaded button; and wherein said plurality of length selectors comprise a plurality of button receivers;

wherein said plurality of T-arm halves are attached to said extension body by an articulating mechanism that allows the plurality of T-arm halves to be positioned at and held in pre-determined angles relative to said extension body; and wherein said torque arm comprises a rectangular cross-section.

* * * * *